United States Patent [19]

Nagy

[11] 4,176,497

[45] Dec. 4, 1979

[54] SLIDING DOOR AND THRESHOLD ARRANGEMENT FOR A RAILWAY PASSENGER CAR COMPARTMENT

[75] Inventor: Ernest J. Nagy, Munster, Ind.

[73] Assignee: Pullman Incorporated, Chicago, Ill.

[21] Appl. No.: 896,943

[22] Filed: Apr. 17, 1978

[51] Int. Cl.[2] ..... E05D 13/02

[52] U.S. Cl. ..... 49/411; 16/93 R; 49/471

[58] Field of Search ..... 49/409–411, 49/471, 412; 16/93 R

[56] References Cited

U.S. PATENT DOCUMENTS

| | | | |
|---|---|---|---|
| 164,503 | 6/1875 | Wood | 49/471 |
| 3,189,313 | 6/1965 | Burns et al. | 16/93 R |
| 3,653,157 | 4/1972 | Casebolt | 49/411 |

*Primary Examiner*—Kenneth Downey
*Attorney, Agent, or Firm*—Richard J. Myers

[57] ABSTRACT

A sliding door and self-cleaning door guide and threshold arrangement for the door opening of a railway passenger car compartment. The invention provides for a threshold plate and a guide channel having a guide plate depending from the door slidingly engaged therein to align the door, and a plurality of slots transversely diverging from the channel and opening to the sides of the threshold plate, thus accommodating self-cleaning of the guide arrangement by utilizing the normal opening and closing movements of the sliding door.

12 Claims, 6 Drawing Figures

SLIDING DOOR AND THRESHOLD ARRANGEMENT FOR A RAILWAY PASSENGER CAR COMPARTMENT

CROSS-REFERENCE TO RELATED PATENT APPLICATIONS

U.S. patent application Ser. No. 861,920 filed Dec. 19, 1977 U.S. patent application Ser. No. 902,511 filed May 3, 1978.

BACKGROUND OF THE INVENTION

1. Field of the Invention

The present invention relates to sliding doors and more particularly to a sliding door and self-cleaning threshold arrangement for a railway passenger car compartment.

2. Description of the Prior Art

The prior art includes U.S. Pat. Nos. 578,273; 586,467; 837,474 and 3,410,027 which pertain to threshold and sealing arrangements for doors. The present invention is an improvement over these designs.

SUMMARY OF THE INVENTION

The present invention relates to a sliding door and self-cleaning door guide and threshold arrangement for the door opening of a railway passenger car compartment.

The construction includes a sliding door having a vertical end member and a panel extending laterally between and connected to the end member. A threshold plate is provided immediately beneath the door which extends the width of the door opening and a guide channel is provided in the threshold plate wherein a guide plate depending from the door is slidably engaged to restrain transverse movement of the door. A plurality of slots transversely diverging from the guide channel and opening to the sides of the threshold are also provided therein to accommodate self-cleaning of the door-guide and threshold as more fully described below.

DESCRIPTION OF THE PREFERRED EMBODIMENT

Figure 1:
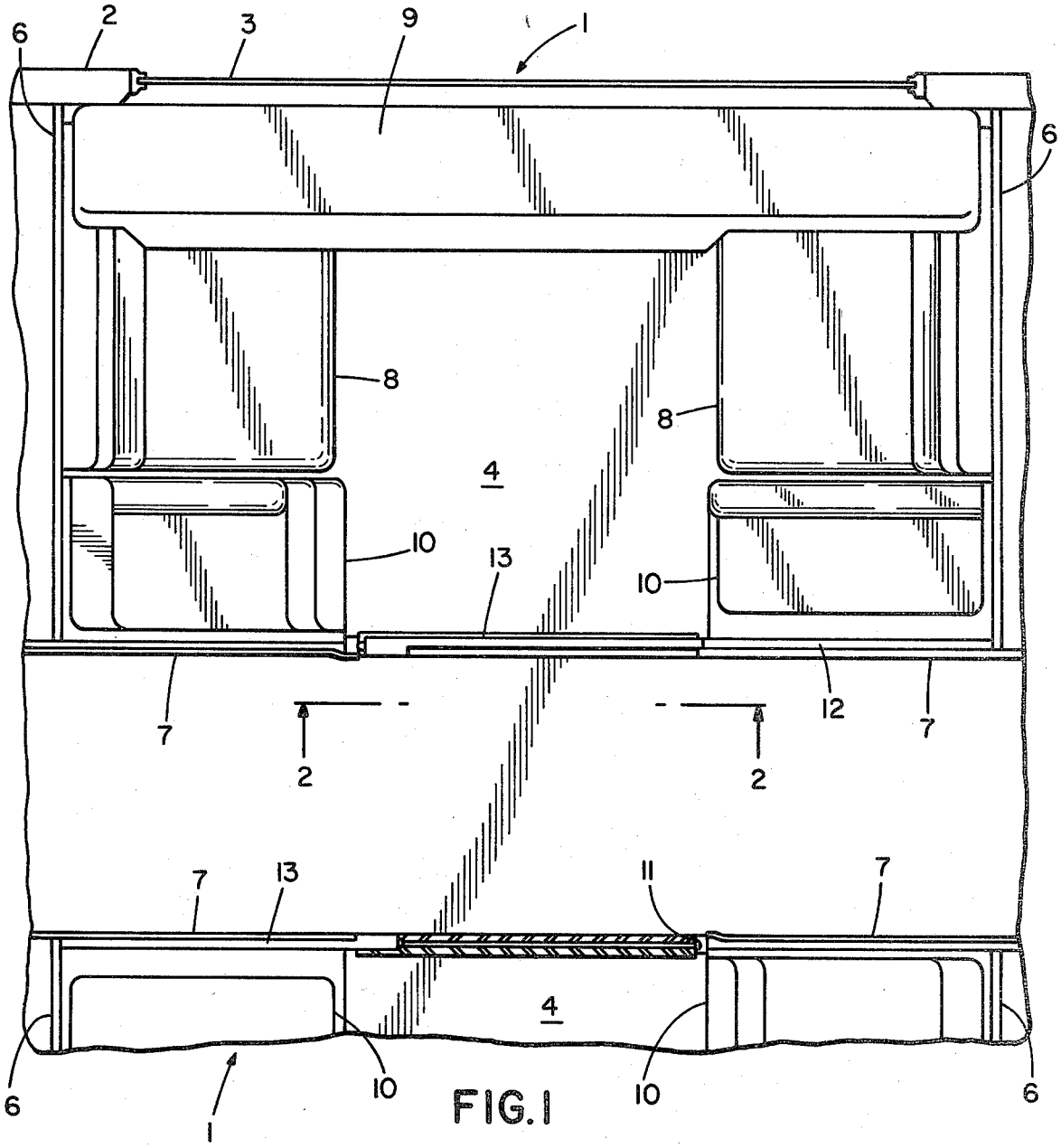
FIG. 1 is a schematic plan view of a sleeping car compartment embodying the novel door arrangement of the present invention.
Figure 3:
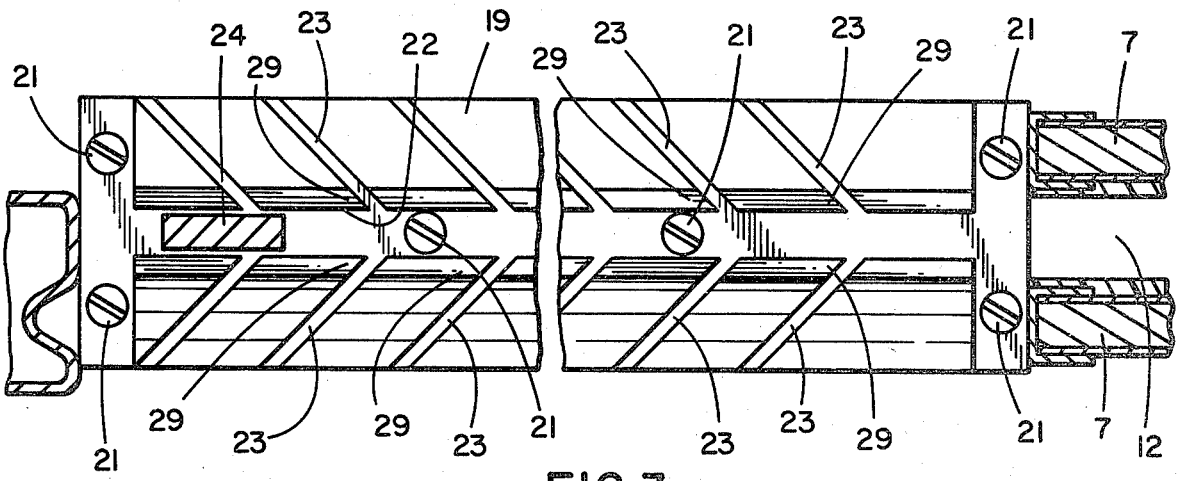
FIG. 3 is a plan sectional view taken generally along line 3—3 in FIG. 2.

Referring now to FIG. 1, a railway passenger car compartment 1 includes a car side 2, a side window 3, and a floor structure 4. As shown in FIG. 1, the compartments are positioned on the opposite sides of an aisle 5 and each includes transversely extending partition walls 6 suitably connected to longitudinally extending divider walls 7. The compartment 1 includes convertible seats 8, an upper berth 9, and combination units of an arm rest, ladder and storage compartment 10. The divider walls 7 are spaced longitudinally to provide a doorway or access opening 11. One of the combination units 10 is suitably spaced from one of the divider walls 7 to provide a storage space or recess designated at 12, which is used when the door 13 is moved to allow passage through the access opening 11.

The door 13 is supported on a header member 14 carrying roller members 14' above the doorway 11, the header 14 being suitably connected to the upper ends of the divider walls 7. The door includes a vertical end member 15 and a panel 16, a window 17, and a door locking or latching arrangement 18 engageable with a keeper or the like on the partition wall 6 (not shown) to secure the door in the closed position as desired.

Figure 2:
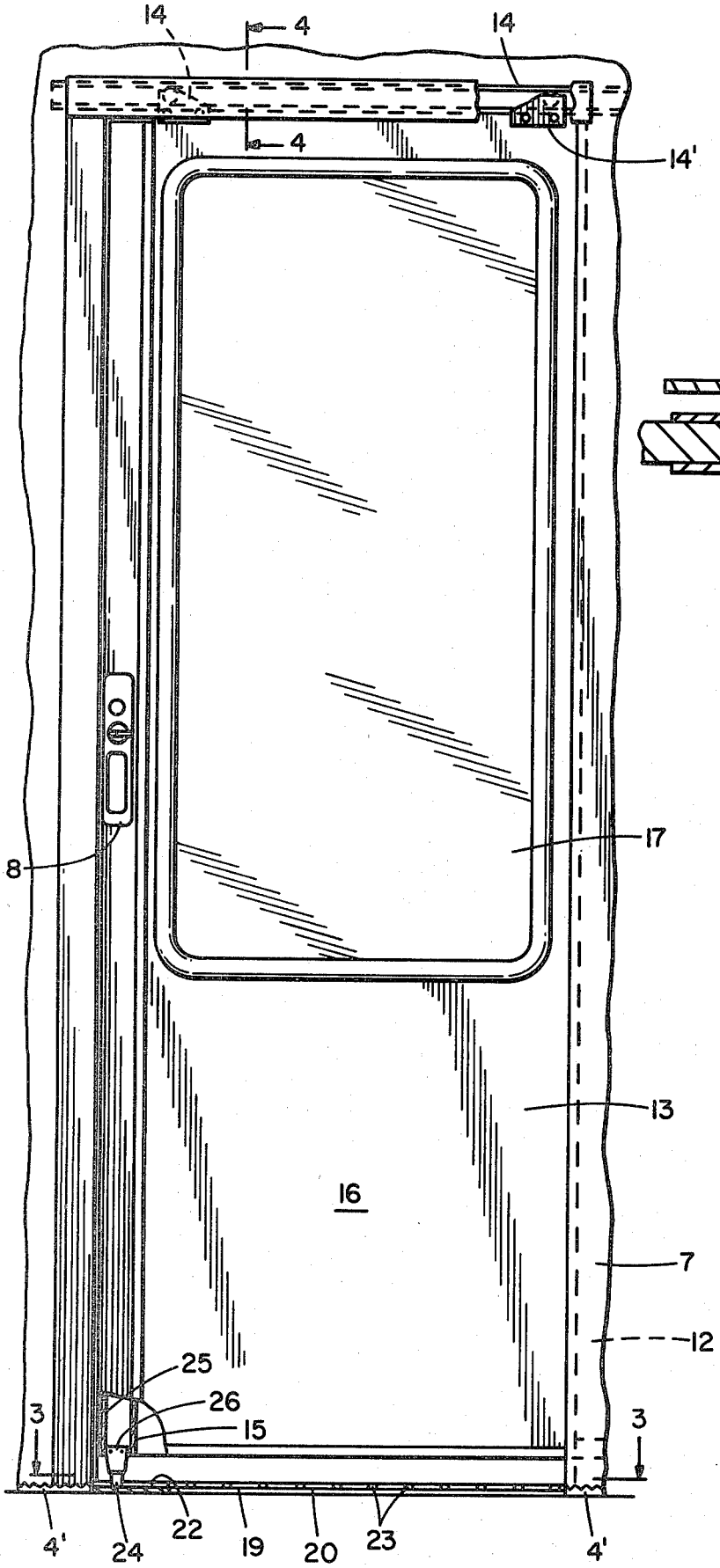
FIG. 2 is an elevational view taken generally along line 2—2 of FIG. 1.
Figure 4:
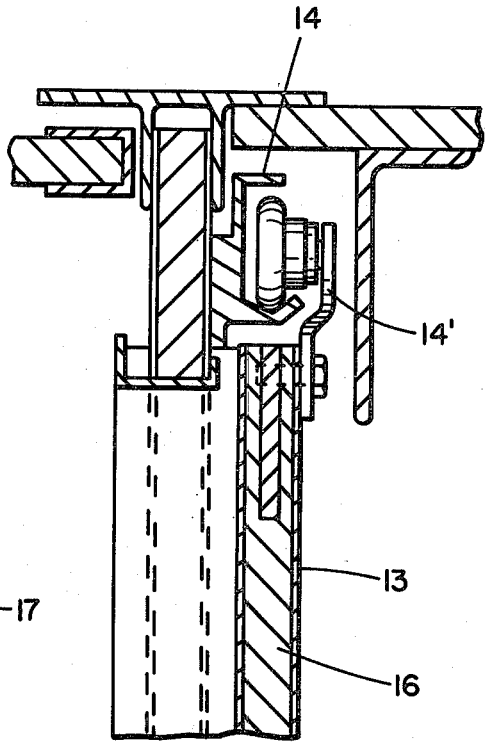
FIG. 4 is an enlarged cross-sectional view taken along line 4—4 in FIG. 1.
Figure 5:
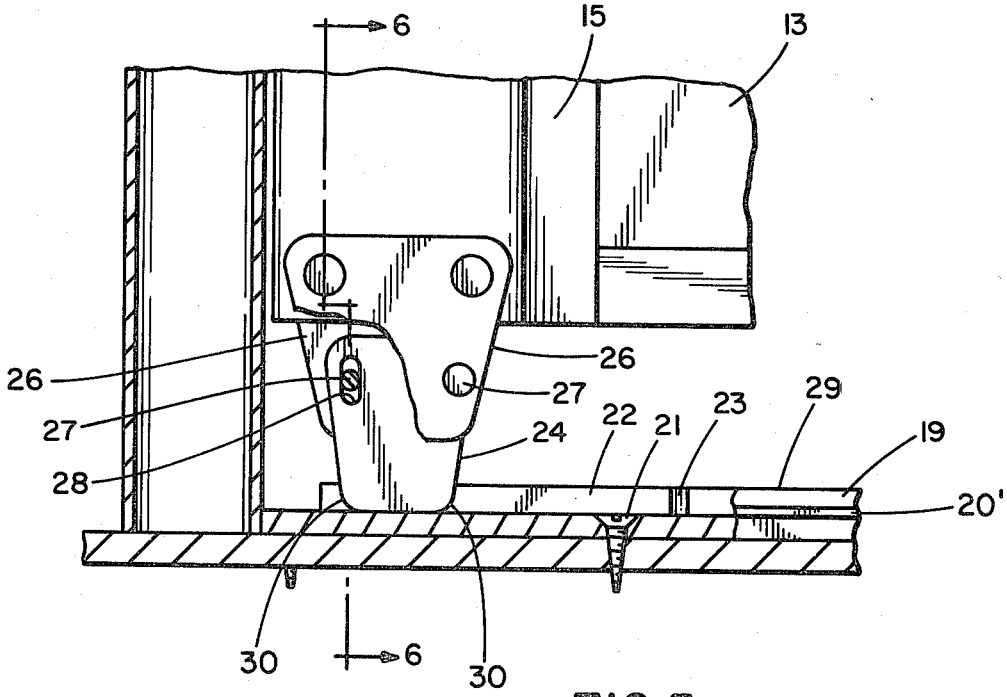
FIG. 5 is an enlarged fragmentary side elevational view partially in section showing the door guide and self-cleaning threshold arrangement.
Figure 6:
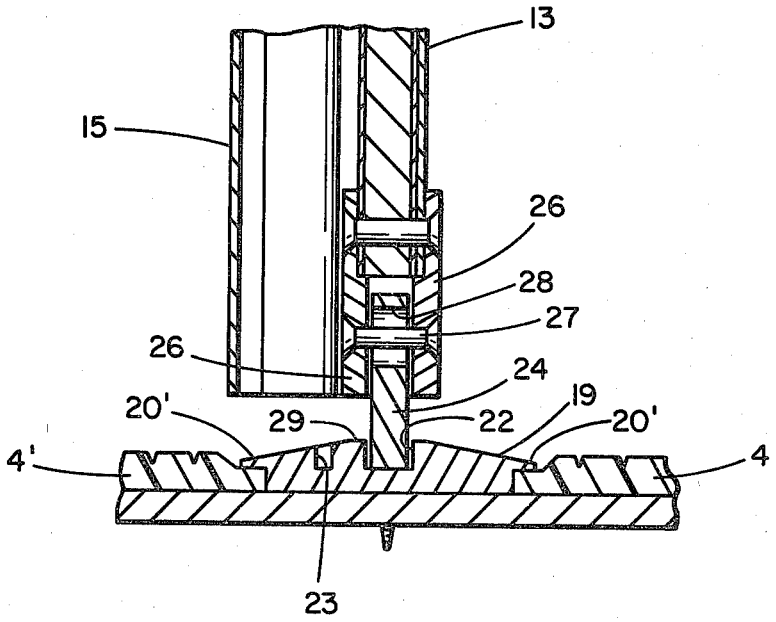
FIG. 6 is a cross-sectional view taken along line 6—6 in FIG. 5.

As best shown in FIGS. 2, 5 and 6, a door guide and self-cleaning threshold arrangement 19 is provided to maintain the door in proper transverse alignment as it is moved between its respective open and closed positions, protect it from damage, etc. The guide and threshold arrangement includes a threshold plate 20 having lip portions 20' overlying and securing the floor covering material 4' and extending the width of the doorway 11 and into the recess 12 as generally indicated in FIG. 2 and which is secured to the floor 4 by screws 21. The threshold includes a longitudinal channel or slot 22 extending the length thereof and a plurality of transversely divergent slots 23 extending therefrom and opening to the sides of the plate, thus forming the herringbone-like slotted configuration illustrated in the drawings. The door is slidably coupled to the threshold plate through a vertical slide plate 24, preferably formed of a self-lubricating thermal plastic material, secured to the lower edge portion of the door generally adjacent to the leading edge or nose 25 thereof and vertically aligned beneath the hand holds or door locking arrangement 18. The slide 24 is sandwiched between a pair of housing or bracket plates 26 forming a clevis-like housing wherein the slide 24 is secured by pins or rivets 27 extending through vertically elongated holes 28 in the slide (only one of which is shown in the drawing) accommodating vertical movement of the slide 24.

It should be particularly noted that each time the door 13 is moved into the closed position, the slide 24 will push or urge accumulations of dirt or other debris which could jam or otherwise render the guide arrangement inoperative outward through the divergent slots 23.

From the foregoing, it can be seen that the self cleaning feature of the guide and threshold plate is particularly enhanced by the herringbone-like configuration of the slots in the plate. Specifically, as the slide 24 moves through the longitudinal slot 22 toward the closed position, debris accumulating ahead of the slide tends to be scooped and channeled outward through a divergent slot 23 as it approaches each respective apex 29 while conversely, because the slide is secured to the door to accommodate vertical movement with respect thereto, if chewing gum or a pebble or the like becomes jammed in the longitudinal slot 22, the curved lower camming edges 30 of the slide will ride up and over the obstacle so as to accommodate re-engagement of the slide in the slot until it can be removed during routine cleaning operations.

Having thus disclosed the invention, it will be apparent that the foregoing description and drawings merely explain and illustrate the invention and that the invention is not limited thereto, except insofar as the appended claims are so limited, as those skilled in the art who have the disclosure before them will be able to make modifications and variations therein without departing from the scope of the invention.

What is claimed is:

1. For a railway passenger car compartment having a floor including an aisle and a pair of longitudinally aligned spaced vertical divider walls adjacent to said aisle and defining an access opening into said compartment, a sliding door and threshold arrangement for said opening, comprising:

a door having a vertical end member and a panel extending laterally of the door connected to said end member, an elongated threshold plate on the floor and extending the width of the access opening beneath the door, said plate having an upwardly opening longitudinally extending guide channel therein and a plurality of spaced diverging slots extending therefrom and opening to the sides of the plate, guide plate means depending from the door and having a vertically yieldable lower end portion slidably engaged within said guide channel to secure the lower end of the door against transverse movement, and said lower end portion being reactive with said threshold plate to scrub foreign matter from the guide channel and move it outwardly through said slots during opening and closing movement of the door.

2. The invention according to claim 1, and said guide plate means including a pair of transversely spaced bracket plates secured to the door and depending therefrom, a slide plate between said bracket plates and extending into said guide channel, and fastening means coupling the slide to the brackets to accommodate predetermined vertical movement of the slide.

3. The invention according to claim 1, and said threshold plate having transversely extending edge lip portions adapted to overlie and secure floor covering material to the floor of the car.

4. The invention according to claim 1, and a pair of rollers and hanger members connected with said door and a horizontal track supported in the compartment above said access opening slidably supporting said rollers and door thereon.

5. The invention according to claim 1, and said slots being a plurality of transversely aligned divergent pairs spaced along the length of the threshold plate.

6. The invention according to claim 1, and said lower end portion of the slide plate having an arcuate lower camming surface slidingly engageable with the threshold within the guide channel.

7. The invention according to claim 1, and said vertical end member including transversely spaced hand holds for sliding said door, said hand hold being vertically aligned above said guide plate means.

8. The invention according to claim 1, and said divergent slots extending longitudinally outwardly in the direction of door travel as it is moved to the closed position.

9. The invention according to claim 2, and said slide plate being of a self-lubricating thermal plastic material.

10. The invention according to claim 1, and said guide plate means including a bracket portion secured to the door, a slide member adjacent said bracket portion and extending into said guide channel, and fastening means coupling said slide member to said bracket portion to accommodate predetermined vertical movement of said slide.

11. For a railway passenger car compartment having a floor including an aisle and a pair of longitudinally aligned spaced vertical divider walls adjacent to said aisle and defining an access opening into said compartment, a sliding door and threshold arrangement for said opening, comprising:

a door having vertical end member and a panel extending laterally of the door connected to said end member, an elongated threshold plate on the floor and extending the width of the access opening beneath the door, said plate having an upwardly opening longitudinally extending guide channel therein and a plurality of spaced diverging slots extending therefrom and opening to the sides of the plate, guide plate means depending from the door and having a lower end portion slidably engaged within said guide channel to secure the lower end of the door against transverse movement, said guide plate means including a pair of transversely spaced bracket plates secured to the door and depending therefrom, a slide plate between said bracket plates and extending into said guide channel, fastening means coupling the slide to the brackets to accommodate predetermined vertical movement of the slide, a pair of rollers and hanger members connected with said door and a horizontal track supported in the compartment above said access opening slidably supporting said rollers and door thereon, and said slots being a plurality of transversely aligned divergent pairs spaced along the length of the threshold plate.

12. For a railway passenger car compartment having a floor including an aisle and a pair of longitudinally aligned spaced vertical divider walls adjacent to said aisle and defining an access opening into said compartment, a sliding door and threshold arrangement for said opening, comprising:

a door having vertical end member and a panel extending laterally of the door connected to said end member, an elongated threshold plate on the floor and extending the width of the access opening beneath the door, said plate having an upwardly opening longitudinally extending guide channel therein and a plurality of spaced diverging slots extending therefrom and opening to the sides of the plate, guide plate means depending from the door and having a lower end portion slidably engaged within said guide channel to secure the lower end of the door against transverse movement, said guide plate means including a bracket portion secured to the door, a slide member adjacent said bracket portion and extending into said guide channel, fastening means coupling said slide member to said bracket portion to accommodate predetermined vertical movement of said slide, suspension means connected with said door and supported in the compartment generally above said access opening for slidably supporting the door, and said slots being spaced along the length of the threshold plate.

* * * * *